US010953257B2

(12) United States Patent
Simpson

(10) Patent No.: US 10,953,257 B2
(45) Date of Patent: Mar. 23, 2021

(54) FIRE SUPPRESSION COMPOSITION

(71) Applicant: Kidde Technologies, Inc., Wilson, NC (US)

(72) Inventor: Terry Simpson, Wake Forest, NC (US)

(73) Assignee: KIDDE TECHNOLOGIES, INC., Wilson, NC (US)

( * ) Notice: Subject to any disclaimer, the term of this patent is extended or adjusted under 35 U.S.C. 154(b) by 46 days.

(21) Appl. No.: 16/388,967

(22) Filed: Apr. 19, 2019

(65) Prior Publication Data

US 2020/0330809 A1 Oct. 22, 2020

(51) Int. Cl.
*A62D 1/00* (2006.01)

(52) U.S. Cl.
CPC ..... *A62D 1/0057* (2013.01)

(58) Field of Classification Search
CPC ..... A62D 1/0057
See application file for complete search history.

(56) References Cited

U.S. PATENT DOCUMENTS

| | | | | |
|---|---|---|---|---|
| 2,692,649 | A | 10/1954 | McCreary | |
| 4,179,218 | A | 12/1979 | Erdmann et al. | |
| 5,155,357 | A | 10/1992 | Hemond | |
| 5,281,816 | A | 1/1994 | Jacobson et al. | |
| 5,616,742 | A | 4/1997 | Robin et al. | |
| 5,695,688 | A | 12/1997 | Nimitz et al. | |
| 5,902,009 | A | 5/1999 | Singh et al. | |
| 6,116,348 | A | 9/2000 | Drakin | |
| 6,181,426 | B1 | 1/2001 | Bender et al. | |
| 6,526,764 | B1 | 3/2003 | Singh et al. | |
| 7,142,105 | B2 | 11/2006 | Chen | |
| 7,178,604 | B2 | 2/2007 | Meserve et al. | |
| 7,384,519 | B2 | 6/2008 | Cottrell et al. | |
| 8,004,684 | B2 | 8/2011 | Powell et al. | |
| 8,733,463 | B2 | 5/2014 | Meier | |
| 9,170,163 | B2 | 10/2015 | Susko | |
| 9,182,331 | B2 | 11/2015 | Hariram | |
| 9,207,172 | B2 | 12/2015 | Seebaluck et al. | |
| 9,233,264 | B2 | 1/2016 | Graham et al. | |
| 9,298,193 | B2 | 3/2016 | Susko | |
| 9,957,061 | B2 | 5/2018 | Stehman et al. | |
| 10,130,909 | B2 | 11/2018 | Low et al. | |
| 10,493,399 | B2 | 12/2019 | Low et al. | |
| 2002/0055175 | A1 | 5/2002 | Casal et al. | |
| 2005/0016741 | A1 | 1/2005 | Paulkovich | |
| 2005/0145820 | A1 | 7/2005 | Waldrop et al. | |
| 2005/0178566 | A1 | 8/2005 | Meserve et al. | |
| 2006/0232773 | A1 | 10/2006 | Barton et al. | |
| 2006/0243944 | A1* | 11/2006 | Minor | C08J 9/149 252/67 |
| 2006/0273223 | A1 | 12/2006 | Haaland et al. | |
| 2008/0011159 | A1 | 1/2008 | Thomas et al. | |
| 2008/0186489 | A1 | 8/2008 | Ahn | |
| 2009/0085224 | A1 | 4/2009 | Choi et al. | |
| 2010/0162738 | A1 | 7/2010 | Low et al. | |
| 2010/0257881 | A1 | 10/2010 | Perti | |
| 2014/0216770 | A1 | 8/2014 | Gibson et al. | |
| 2014/0231660 | A1 | 8/2014 | Fabre et al. | |
| 2014/0233017 | A1 | 8/2014 | Hariram | |
| 2015/0041157 | A1 | 2/2015 | Mitchell et al. | |
| 2015/0328489 | A1 | 11/2015 | Mondino | |
| 2015/0376546 | A1* | 12/2015 | Diaz Gomez | C07D 307/12 424/70.1 |
| 2016/0096051 | A1 | 4/2016 | Baker et al. | |
| 2016/0296780 | A1 | 10/2016 | Singh et al. | |
| 2017/0072235 | A1 | 3/2017 | Ferguson et al. | |
| 2018/0002586 | A1 | 1/2018 | Low et al. | |
| 2018/0201817 | A1 | 7/2018 | Close et al. | |
| 2018/0217054 | A1 | 8/2018 | Deguchi et al. | |
| 2018/0318623 | A1 | 11/2018 | Richard et al. | |
| 2019/0024126 | A1 | 1/2019 | Beckham et al. | |
| 2019/0055442 | A1* | 2/2019 | Singh | C09K 5/045 |
| 2019/0083927 | A1 | 3/2019 | Low et al. | |
| 2019/0085224 | A1 | 3/2019 | Sethi et al. | |
| 2019/0161663 | A1 | 5/2019 | Sethi et al. | |
| 2019/0168035 | A1 | 6/2019 | Conboy | |
| 2019/0177589 | A1 | 6/2019 | Sethi et al. | |
| 2020/0208882 | A1 | 7/2020 | Ota et al. | |
| 2020/0333233 | A1 | 10/2020 | Simpson et al. | |

FOREIGN PATENT DOCUMENTS

| | | | |
|---|---|---|---|
| CN | 108195796 | A | 6/2018 |
| GB | 2439209 | A | 12/2007 |
| JP | 60139262 | S | 7/1985 |
| JP | 08277389 | H | 10/1996 |
| JP | 2018153463 | A | 10/2018 |
| WO | 9743012 | A1 | 11/1997 |
| WO | 2010001430 | A2 | 1/2010 |

OTHER PUBLICATIONS

Final Office Action for U.S. Appl. No. 16/388,975; Application Filing Date Apr. 19, 2019; dated Apr. 16, 2020; 16 pages.
Final Office Action for U.S. Appl. No. 16/413,100; Application Filing Date May 15, 2019; dated Apr. 16, 2020, 17 pages.
Non-Final Office Action for U.S. Appl. No. 16/388,959; Application Filing Date Apr. 19, 2019; dated May 26, 2020; 33 pages.
European Search Report for European Application No. 19212840.3; Application Filing Date: Dec. 2, 2019; dated Jul. 14, 2020, 9 pages.
European Search Report for European Application No. 19212780.1; Date of Filing: Dec. 2, 2019; dated Jun. 24, 2020; 6 pages.
Non-Final Office Action for U.S. Appl. No. 16/413,166, Application Filing Date May 15, 2019, NFOA Notification Date: Nov. 7, 2019, 11 pages.
European Search Report for European Application No. 19211917.0; Application Filing Date: Nov. 27, 2019; dated Jun. 23, 2020; 7 pages.
European Search Report for European Application No. 19212793.4; Application Filing Date: Dec. 2, 2019; dated Jun. 23, 2020, 7 pages.
European Search Report for European Application No. 19212814.8; Application Filing Date: Dec. 2, 2019; dated Jun. 23, 2020, 14 pages.
3M™ Novec™ Brand, 3M™ Novec™ 1230 Fire Protection Fluid, Technical Data, Jan. 2020, 12 pages.

(Continued)

*Primary Examiner* — Andrew J. Oyer
(74) *Attorney, Agent, or Firm* — Cantor Colburn LLP

(57) ABSTRACT

Disclosed herein is a fire suppression composition including $CF_3I$, an anti-freeze compound, and an odorant compound, wherein the anti-freeze compound and the odorant compound are radical scavengers.

20 Claims, No Drawings

(56) References Cited

OTHER PUBLICATIONS

Final Office Action for U.S. Appl. No. 16/413,166, Application Filing Date May 15, 2019, FOA Notification Date: Mar. 9, 2020, 14 pages.
Non-Final Office Action for U.S. Appl. No. 16/413,100; Application Filing Date May 15, 2019; Notification Date Jan. 9, 2020, 19 pages.
Non-Final Office Action for U.S. Appl. No. 16/388,975; Application Filing Date Apr. 19, 2019; Noification Date Jan. 9, 2020; 24 pages.
Non-Final Office Action for U.S. Appl. No. 16/388,967; Application Filing Date: Apr. 19, 2019; Notification Date: Aug. 4, 2020, 42 pages.
Extended European Search Report for European Application No. 19212814.8; Application Filing Date: Dec. 2, 2020; dated Sep. 29, 2020; 12 pages.
Final Office Action for U.S. Appl. No. 16/388,959; Application Filing Date: Apr. 19, 2019; dated Sep. 9, 2020; 22 pages.
Non-Final Office Action for U.S. Appl. No. 16/388,975; Application Filing Date: Apr. 19, 2019; dated Sep. 18, 2020; 31 pages.
Non-Final Office Action for U.S. Appl. No. 16/413,100; Application Filing Date: May 15, 2019; dated Sep. 17, 2020; 29 pages.

* cited by examiner

FIRE SUPPRESSION COMPOSITION

BACKGROUND

Exemplary embodiments of the present disclosure pertain to the art of fire suppression compositions.

Halon 1301 has frequently been employed as a fire suppression agent but there is currently a desire to replace Halon 1301 with more environmentally friendly fire suppression agents or blends of agents. Some of the proposed alternatives to Halon 1301 are less stable than Halon 1301 so solutions must be found that will improve the stability of the alternative fire suppression agents and allow the alternative fire suppression agents to be stored in the fire extinguisher system for extended periods of time.

BRIEF DESCRIPTION

Disclosed is a fire suppression composition including $CF_3I$, an anti-freeze compound, and an odorant compound, wherein the anti-freeze compound and the odorant compound are radical scavengers.

In addition to one or more of the features described above, or as an alternative to any of the foregoing embodiments, the anti-freeze compound may include methanol, ethanol, propanol, ethylene glycol, propylene glycol, glycerol or a combination thereof.

In addition to one or more of the features described above, or as an alternative to any of the foregoing embodiments, the odorant compound may have a freezing point less than or equal to −85° F. under storage conditions.

In addition to one or more of the features described above, or as an alternative to any of the foregoing embodiments, the odorant compound may include two or more carbon-carbon double bonds. The odorant compound may further include a hydroxyl group, an iodine group, or both.

In addition to one or more of the features described above, or as an alternative to any of the foregoing embodiments, the odorant compound may be aromatic. The odorant compound may further include a hydroxyl group, an iodine group, or both.

In addition to one or more of the features described above, or as an alternative to any of the foregoing embodiments, the odorant compound may be present in an amount less than or equal to 1 weight percent, based on the total weight of the fire suppression composition.

In addition to one or more of the features described above, or as an alternative to any of the foregoing embodiments, the anti-freeze compound may be present in an amount less than or equal to 2 weight percent, based on the total weight of the fire suppression composition.

In addition to one or more of the features described above, or as an alternative to any of the foregoing embodiments, the fire suppression composition may have a freezing point less than or equal to −85° F. under storage conditions.

A fire suppression composition including at least 30 wt % $CF_3I$ based on the total weight of the fire suppression composition, an anti-freeze compound, and an odorant compound, wherein the anti-freeze compound and the odorant compound are radical scavengers.

In addition to one or more of the features described above, or as an alternative to any of the foregoing embodiments, the anti-freeze compound may include methanol, ethanol, propanol, ethylene glycol, propylene glycol, glycerol or a combination thereof.

In addition to one or more of the features described above, or as an alternative to any of the foregoing embodiments, the odorant compound may have a freezing point less than or equal to −85° F. under storage conditions.

In addition to one or more of the features described above, or as an alternative to any of the foregoing embodiments, the odorant compound may include two or more carbon-carbon double bonds. The odorant compound may further include a hydroxyl group, an iodine group, or both.

In addition to one or more of the features described above, or as an alternative to any of the foregoing embodiments, the odorant compound may be aromatic. The odorant compound may further include a hydroxyl group, an iodine group, or both.

In addition to one or more of the features described above, or as an alternative to any of the foregoing embodiments, the odorant compound may be present in an amount less than or equal to 1 weight percent, based on the total weight of the fire suppression composition.

In addition to one or more of the features described above, or as an alternative to any of the foregoing embodiments, the anti-freeze compound may be present in an amount less than or equal to 2 weight percent, based on the total weight of the fire suppression composition.

In addition to one or more of the features described above, or as an alternative to any of the foregoing embodiments, the fire suppression composition may have a freezing point less than or equal to −85° F. under storage conditions.

DETAILED DESCRIPTION

A detailed description of one or more embodiments of the disclosed apparatus and method are presented herein by way of exemplification and not limitation with reference to the FIGURES.

$CF_3I$ and blends including $CF_3I$ are an environmentally attractive alternative to fire suppression agents like Halon 1301 because $CF_3I$ has a lower ozone depletion potential. The lower ozone depletion potential is due to the lower stability of the molecule. The lower stability (or the increased tendency to degrade) presents a challenge for long term storage of $CF_3I$ or blends containing $CF_3I$ as a fire suppression agent. $CF_3I$ forms radicals as it degrades and these radicals can initiate further degradation and undesirable by products. The lower stability has discouraged the use of $CF_3I$ and $CF_3I$ blends in applications requiring long term storage. Long term storage is define herein as greater than or equal to 5 years. In some embodiments the fire suppression composition can be stored for 5-20 years. One approach to resolving the storage problem is to include one or more radical scavenging agents in the fire suppression composition.

Additionally, $CF_3I$ has a cardiosensitization level below the concentration needed for fire suppression. Accordingly, it is desirable to include an odorant as an early warning indicator in the case of an accidental release of the fire suppression composition.

The fire suppression system stores the fire suppression composition in liquid form under pressure and releases the composition by a reduction in pressure and expansion through a valve. If water is present in the composition the water can freeze due to the drop in temperature and clog the valve. An anti-freeze compound is needed to lower the freezing point of the composition as a whole, including any water that may be present.

By employing an anti-freeze compound and an odorant that are radical scavengers the foregoing needs can be met with a minimum of components and interactions. Simplifying the number of components minimizes the risk of unforeseen interactions between the components over time in storage and simplifies the distribution of the components when released into a protected space.

The fire suppression agent includes $CF_3I$ optionally in combination with one or more of HFC-125, HCFO-1233zd (E), Novec 1230, and $CO_2$. When used in combination with another fire suppression agent the $CF_3I$ may be present in an amount greater than or equal to 30 weight percent, or, greater than or equal to 35 weight percent, or, greater than or equal to 40 weight percent, based on the total weight of the fire suppression composition. Exemplary compositions are shown in the following table.

| | |
|---|---|
| CF3I<br>45 wt % | HFC-125<br>55 wt % |
| CF3I<br>44 wt % | Novec 1230<br>56 wt % |
| CF3I<br>65 wt % | HFCO-1233zdE<br>35 wt % |

Exemplary anti-freeze compounds include methanol, ethanol, propanol, ethylene glycol, propylene glycol, glycerol or a combination thereof. The anti-freeze compound is employed in an amount sufficient to reduce the freezing point of the composition to less than or equal to −85° F. at under storage conditions. The anti-freeze may be present in an amount less than or equal to 2.5 wt %, more specifically 0.5 to 2.0 wt %, based on the total weight of the fire suppression composition.

The odorant is an organic compound which can function as a radical scavenger. The odorant has at least two carbon-carbon double bonds which may be conjugated. In some embodiments the odorant is aromatic. The odorant may further comprise a hydroxyl group or an iodine group. The odorant may have a melting point below the minimum operating temperature −85° F.

Exemplary odorants include 2-phenoxyethanol, citronellol, citronellal, limonene, methyl salicylate, and combinations thereof.

The odorant may be present in an amount less than or equal to 1 wt %, based on the total weight of the fire suppression composition. In some embodiments the odorant is present in an amount less than or equal to 0.75 wt %, based on the total weight of the fire suppression composition.

Operating conditions, as used herein, refer to temperatures of −65° F. to 200° F. and pressures of 1.05 to 15.7 PSIA (7.24 to 101.3 kPa A).

Storage conditions, as used herein, refer to temperatures of −85 to 205° F. and pressures of 11 to 15.7 PSIA.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A fire suppression composition comprising $CF_3I$, an anti-freeze compound, and an odorant compound, wherein the anti-freeze compound and the odorant compound are radical scavengers and the anti-freeze compound is present in an amount of 0.5 to 2.5 wt %, based on the total weight of the fire suppression composition.

2. The fire suppression composition of claim 1, wherein the anti-freeze compound comprises methanol, ethanol, propanol, ethylene glycol, propylene glycol, glycerol or a combination thereof.

3. The fire suppression composition of claim 1, wherein the odorant compound has a freezing point less than or equal to −85° F. under storage conditions.

4. The fire suppression composition of claim 1, wherein the odorant compound comprises two or more carbon-carbon double bonds.

5. The fire suppression composition of claim 4, wherein the odorant compound further comprises a hydroxyl group, an iodine group or both.

6. The fire suppression composition of claim 1, wherein the odorant compound is an aromatic compound.

7. The fire suppression composition of claim 6, wherein the odorant compound further comprises a hydroxyl group, an iodine group or both.

8. The fire suppression composition of claim 1, wherein the odorant compound is present in an amount less than 1 wt %, based on the total weight of the fire suppression composition.

9. The fire suppression composition of claim 1, wherein the anti-freeze compound may be present in an amount of 0.5 to 2 wt %, based on the total weight of the fire suppression composition.

10. The fire suppression composition of claim 1, wherein the fire suppression composition has a freezing point less than or equal to −85° F. under storage conditions.

11. A fire suppression composition comprising at least 30 wt % $CF_3I$ based on the total weight of the fire suppression composition, an anti-freeze compound, and an odorant compound, wherein the anti-freeze compound and the odorant compound are radical scavengers and the anti-freeze compound is present in an amount of 0.5 to 2.5 wt %, based on the total weight of the fire suppression composition.

12. The fire suppression composition of claim 11, wherein the anti-freeze compound comprises methanol, ethanol, propanol, ethylene glycol, propylene glycol, glycerol or a combination thereof.

13. The fire suppression composition of claim 11, wherein the odorant compound has a freezing point less than or equal to −85° F. under storage conditions.

14. The fire suppression composition of claim 11, wherein the odorant compound comprises two or more carbon-carbon double bonds.

15. The fire suppression composition of claim 14, wherein the odorant compound further comprises a hydroxyl group, an iodine group or both.

16. The fire suppression composition of claim 11, wherein the odorant compound is an aromatic compound.

17. The fire suppression composition of claim 16, wherein the odorant compound further comprises a hydroxyl group, an iodine group or both.

18. The fire suppression composition of claim 11, wherein the odorant compound is present in an amount less than 1 wt %, based on the total weight of the fire suppression composition.

19. The fire suppression composition of claim 11, wherein the anti-freeze compound may be present in an amount of 0.5 to 2 wt %, based on the total weight of the fire suppression composition.

20. The fire suppression composition of claim 11, wherein the fire suppression composition has a freezing point less than or equal to −85° F. under storage conditions.

* * * * *